United States Patent [19]

Hunter

[11] Patent Number: 4,930,239

[45] Date of Patent: Jun. 5, 1990

[54] DUAL ACTION (FUNCTION) INTEGRAL TARGET RIFLE

[76] Inventor: Gary R. Hunter, 2530 Oak Grove Pl., Toledo, Ohio 43613

[21] Appl. No.: 371,835

[22] Filed: Jun. 27, 1989

[51] Int. Cl.[5] ..... F41A 3/54

[52] U.S. Cl. ..... 42/42.01; 89/194

[58] Field of Search ..... 42/75.01, 75.02, 75.03, 42/42.01; 89/194

[56] References Cited

U.S. PATENT DOCUMENTS 4,651,455 3/1987 Geiser, Jr. .

FOREIGN PATENT DOCUMENTS 341412 11/1959 Switzerland ..... 89/194

*Primary Examiner*—Charles T. Jordan

*Assistant Examiner*—Richard W. Wendtland

[57] ABSTRACT

A dual function semi automatic single shot rifle of simple, economical and durable construction is disclosed. A one piece receiver hollowed out for strength and weight reduction also acting as the rear stock houses a simple internal working mechanism, a sliding bolt carrier that is adjustable for various cartridge pressures, and also serving as a manual draw back action by tightening the operating spring adjustment screw. A single piece barrel of simple design is attached to the receiver at four location points, thus provided is a simple assembly with a minimum of internal working parts.

5 Claims, 3 Drawing Sheets

DUAL ACTION (FUNCTION) INTEGRAL TARGET RIFLE

BACKGROUND OF THE INVENTION

The objective of the invention is to provide a special high quality firearm of extraordinary accuracy and low cost manufacturing modalities as compared to conventional semi automatic firearms of the rifle class. A further advantage is to provide a rifle of such simple design and function of the internal and external working mechanism, so that the invention can be assembled and dis assembled with great ease and without loss of accuracy in that process. A further feature and advantage of the present invention over the prior art exists in its regulated non deflecting operating spring which serves a dual purpose, such as offsetting the back pressure of various cartridge loads and to also tighten down without this feature so that the action can be operated manually without the semi automatic function. Still another feature of the invention is to provide a solid one piece unitary embodiment which serves as the rear stick as well as the receiver housing, which in turn is comprised of minimal working parts and thus presents lower manufacturing costs of conventional semi automatic rifles. Other features and advantages will become apparent to those skilled in the art during the following summary of the invention.

FIELD OF THE INVENTION

This invention applys to the target class of commercially manufactured firearms.

DESCRIPTION OF PRIOR ART

This invention applys to the target class of commercially manufactured firearms and nothing like it exists for comparison, due to the inventions unique construction and function. Specific problems that this invention solves over other semi automatic rifles exists in its simple design and low manufacturing costs. It has minimal internal components, offers easier one shot loading. Its constuction is of such simplicity that assembly and disassembly found to be generally difficult common to most semi automatic firearms is quite the opposite in this inventions ability to be assembled and disassembled with great ease and in a more complete stage of tear down sequence uncommon to semiautomatic firearms as a whole.

SUMMARY

This invention incorporates two main embodiments comprised of a one piece barrel secured in four ways to a one piece stock and also serves as the receiver housing. Its advantage over prior art remains in its simplicity of manufacture and extensive elimination of unnecessary parts and sub assemblies not directly associated with the functional operation of discharging the firearm as exists in other firearms in the semi automatic (summary continued from page 1)-class. This invention offers a multi adjusting action designed to facilitate accuracy not to be found on other semi automatic rifles in its particular class or in those catagories of common semi automatic rifles not in its designated class. The final feature of advantage over other prior art exists in the ease of loading and unloading one single shot with great ease and minimal manual effort.

BRIEF DESCRIPTION OF DRAWINGS

FIG. 3, showing the hammer, operating spring and method of barrel attachement.

FIG. 3, through the receiver showing the front of the bolt chamber as it is attached to the guide rails of the receiver.

FIG. 5, showing the extractor.

FIG. 3, showing the bolt carrier, firing pin, firing pin retainer, bolt pull back handle, in the chambered position.

DESCRIPTION OF THE PREFERRED EMBODIMENTS

Figure 2:
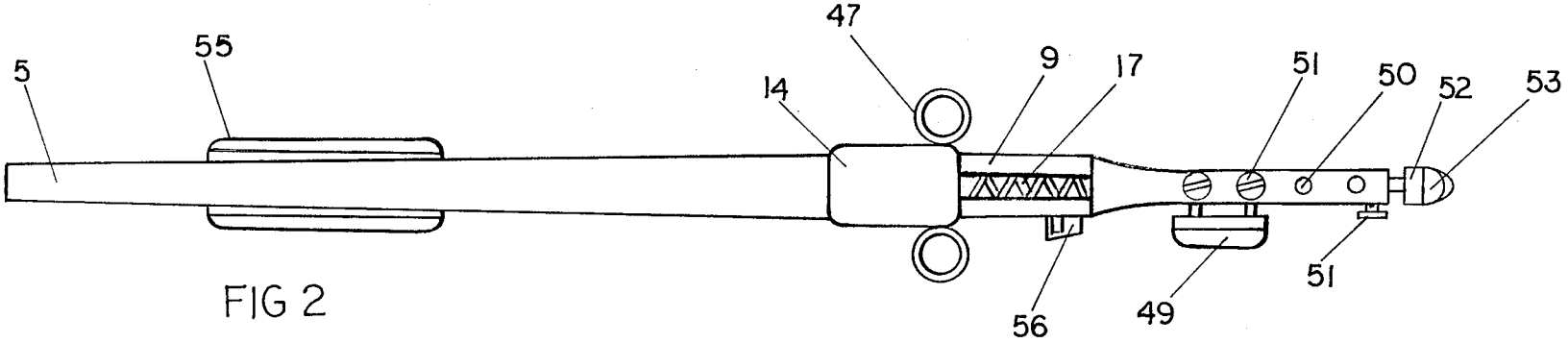
FIG. 2 is a plan view of the rifle.
Figure 1:
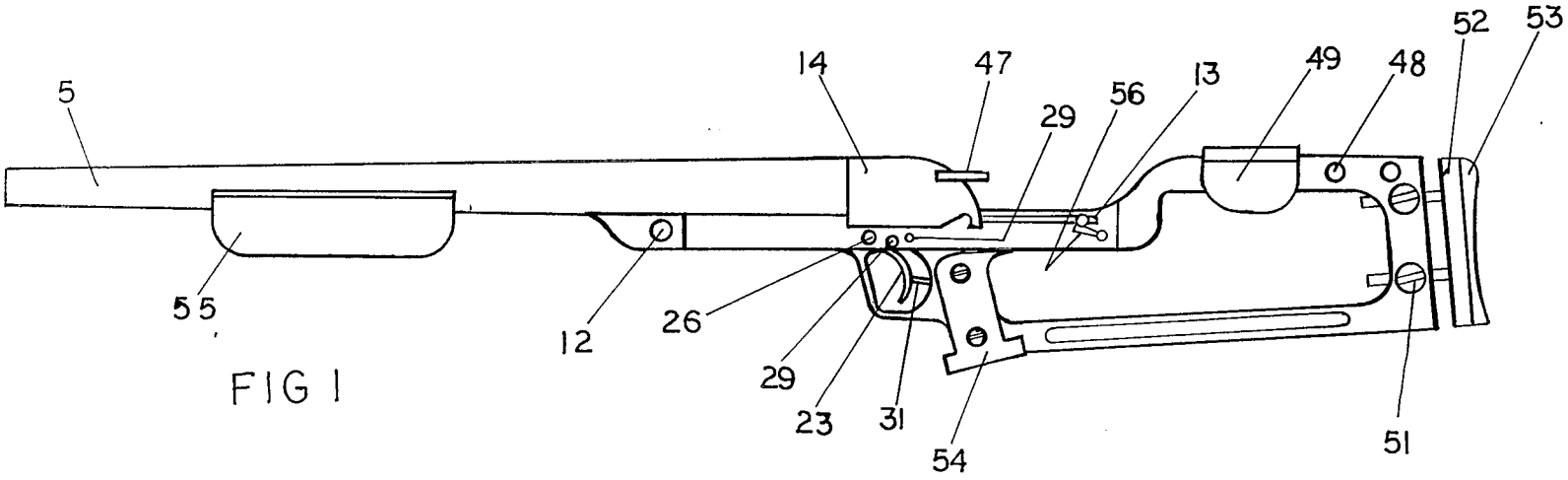
FIG. 1 is an elevation view of the Dual Function Semi Automatic Single shot rifle according to the present invention.
Figure 3:
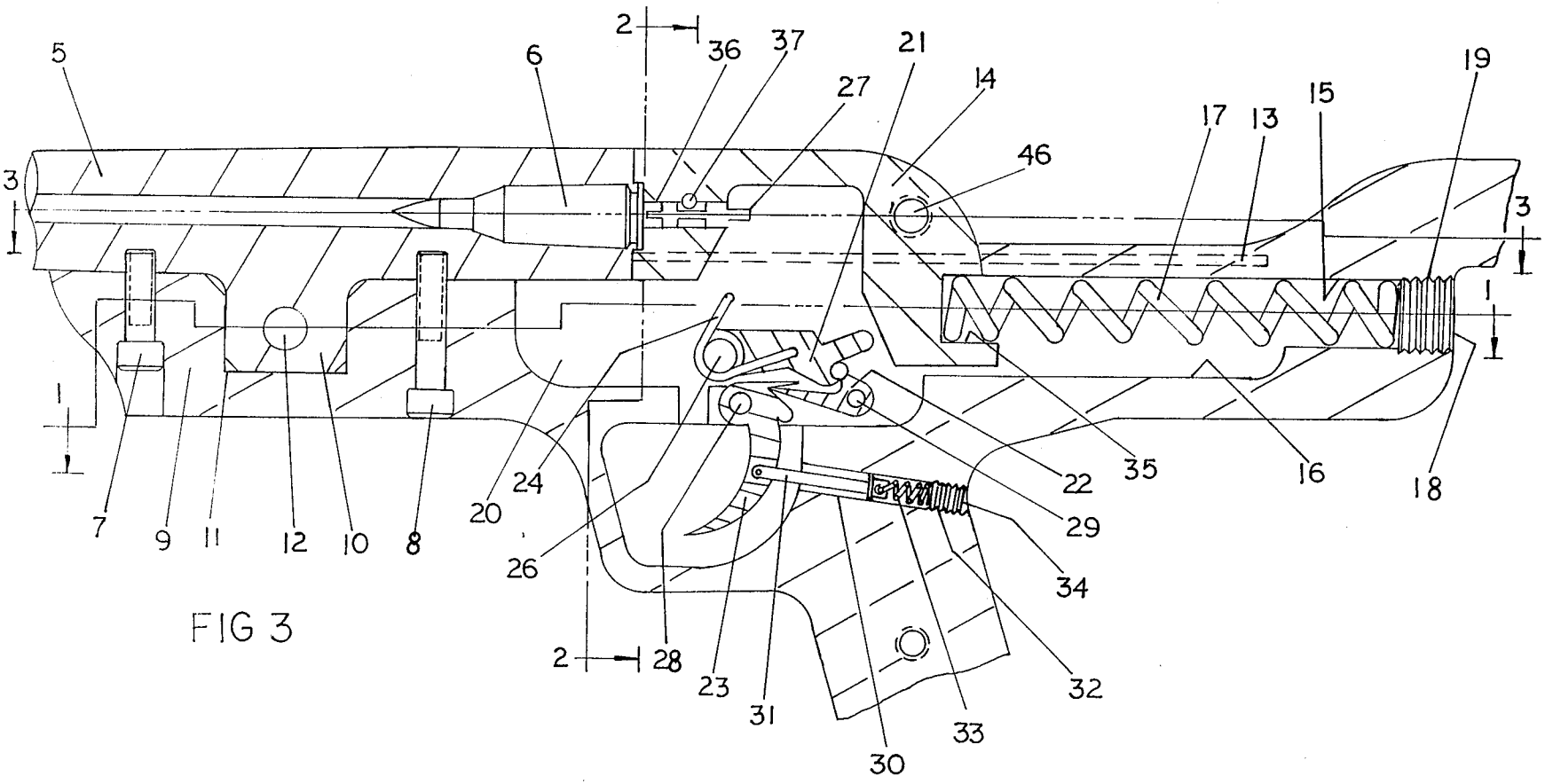
FIG. 3 is a full size sectional fragmantary elevation view showing the method of fastening the barrel to the one piece receiver,the adjustable bolt carrier,and the trigger discharging mechanism of the rifle.
Figure 4:
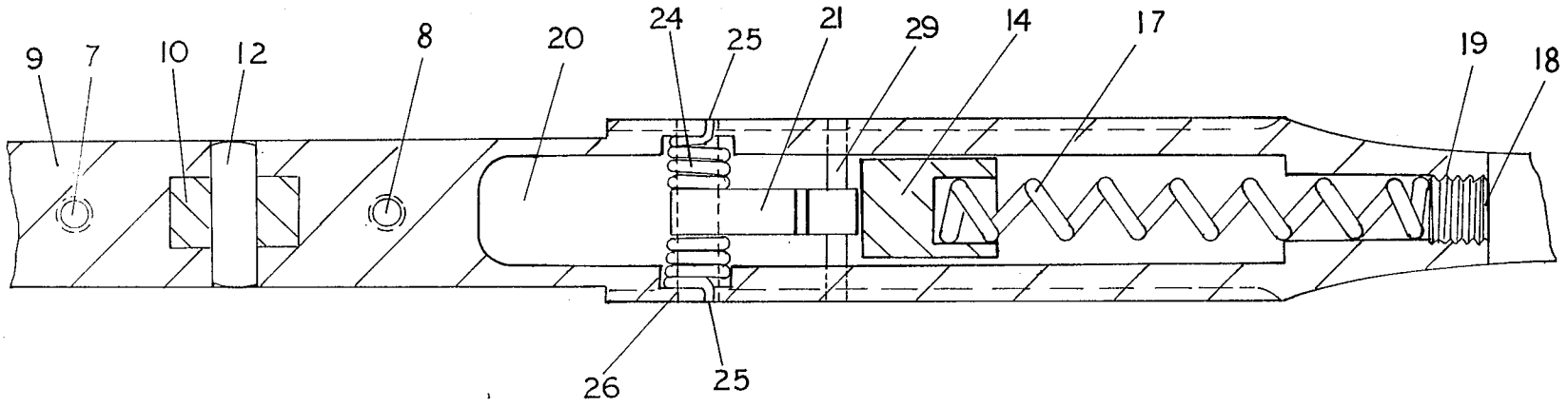
FIG. 4 is a fragmentary full size central vertical section taken through the receiver on section line 1.
Figure 7:
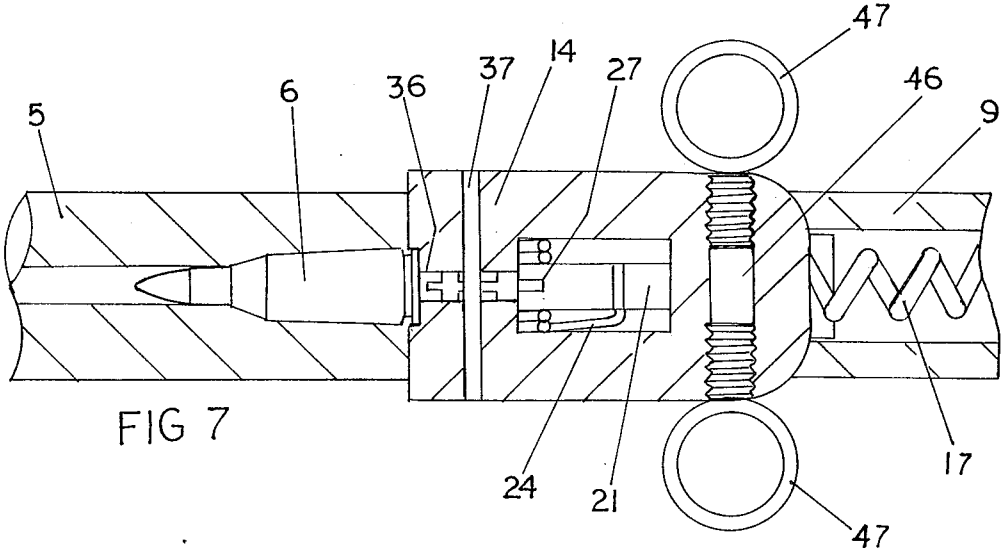
FIG. 7 is a full size fragmantery cut view taken along the center line of the bore line 3.
Figure 6:
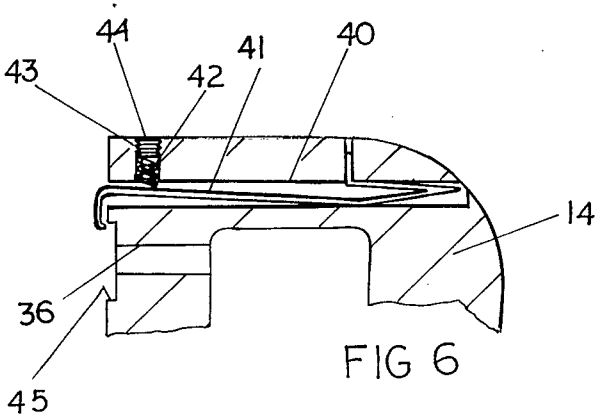
FIG. 6 is a fragmentary sectional view taken from section line 4.
Figure 5:
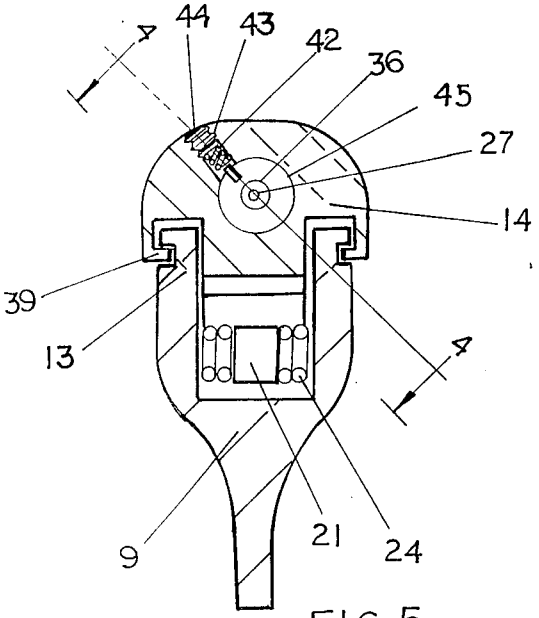
FIG. 5 is a full size sectional view taken from section line 2.

Refering to the drawings in detail wherin like numerals designate like parts, a simple single shot semi automatic rifle according to the invention comprises a barrel 5 having a cartridge chamber 6 at its rear FIG-3, and said barrel 5 is threaded by socket head cap screw 7 and socket head cap screw 8 to receiver 9 having machined lug 10 FIG. 3, set into close fit with cavity 11 FIG. 4 for location in the receiver also serving as a unitary single embodiment comprising the rear stock. The receiver housing 9 is machined to accept barrel 5 with cavity 11 and screw thread 7 and screw thread 8 FIG. 4. Two slots 13 serving as guide ways are machined into receiver 9 to accept movement of the bolt carrier 14. A hole 15 and clearence cavity 16 are machined into the rear of the bolt carrier and non deflecting operating spring 17 FIG. 3. ½-13 threads 19 are machined into the hole 15 to accept the spring adjusting screw 18 FIG. 3. A frontal cavity 20 is machined into the central part of the receiver 9 FIG. 3 to accommodate clearance for the hammer 21, sear 22, trigger 23, trigger spring 24, in the configuration shown in FIG. 3. Two holes 25 are drilled in receiver to accept trigger spring ears. A fulcrum pin 26 is press fit through the receiver 9 allowing hammer to swing upward to strike floating firing pin 27 FIG. 3. A trigger pin 28 is pressed through receiver 9 and allows trigger to move minimally and thus pivot sear 22 just off center of sear pin 29 so as to release hammer in the configuration shown FIG. 3. In the lower part (description continued from page 2)—of the receiver 9 near the palm grip a hole 30 is milled to accept the adjustable trigger plunger 31. Behind the clearance hole 30, threads 32 are tapped to accept backlash spring 33 and adjusting backlash set screw 34. The bolt carrier 14 which slides into the milled grooves 13 of the receiver 9 contains a hole 35 reamed into its rear to accept the operating spring 17 FIG. 3. On the center line of the bore 3 a hole 36 is reamed through to accept the firing pin 27 FIG. 3. A cross hole containing the firing pin retainer 37 is reamed in the bolt carrier just above center line of the bore, FIG. 7. A clearance cut out 38 FIG-5,is milled into the bolt carrier 24 so as to allow the bolt carrier to slide on its machined way guides 39 mating with grooves 13 in the receiver 9 FIG. 5. A hole 40 is milled in the bolt carrier to accommodate the extractor 41 held and secured by spring 42 contained in threaded hole 43 by adjustable set screw 44 FIG. 6. On the face of the bolt carrier 14 is a conterbored machined inset hole 45 which holds and properly aligns the cartridge in the chamber 6. At the rearward part of the bolt carrier on the center line of the bore is a through hole 46 FIG. 3 which accepts the bolt carrier finger pull handle 47, FIG. 7. At the rearward part of the stock 9 holes 48 are drilled through the upper rib to accommodate the adjustable position cheek rest 49 FIG. 1. On the top of the rib according to the configuration four holes 50 are tapped to accept locking independent thumb screws 51. At the butt end of the stock 9, two holes are drilled to accept two tubular rods 52 attached to the adjustable butt plate 53 FIG. 1. At the grip part of the stock 9, a micarta or suitable plastic wrap around hand fit grip is used for a handles 54. At the foreward lower part of the barrel 5 an adjustable foreand grip 55 is attached FIG. 1., and Carrier catch 56 locks carrier in back position. The terms and expressions which have been employed herin are used as terms of description and not of limitation, and there is no intention in the use of such terms and expressions, of excluding any equivalents of the features shown and described or portions thereof, but it is recognized that various modifications are possible within the scope of the invention claimed. (The below written Claims supercede the newly submitted claims dated 10/13/89 received by The Patent Office 10/17/89 and hereby stand as the Final Claims in the above numbered patent application).

I claim:

1. A semi-automatic single shot blow-back rifle comprising a barrel connected to a receiver and a stock forming a single piece having an upper horizontal stock member, a rear vertical stock member, a bottom horizontal stock member, and a pistol grip connected together so as to form a rectangular structure, said receiver having grooves, a bolt, and a cavity, said cavity in rear portion having a spring to urge said bolt against said barrel and in a middle portion housing a trigger, a sear, and a spring loaded hammer, said trigger having a wedge groove cooperating with said sear to release said hammer, said bolt having a hollow center to allow said hammer to strike a firing pin.

2. A semi-automatic single shot blow-back rifle as defined in claim 1 wherein said bolt in a rear portion comprises a reamed hole to accept said spring.

3. A semi-automatic-single shot blow back rifle as defined in claim 1 wherein said bolt further comprises a shell extractor.

4. A semi-automatic single shot blow-back rifle as defined in claim 1 wherein said upper horizontal stock member in a middle portion comprises a check rest.

5. A semi-automatic single shot blow-back rifle as defined in claim 1 wherein said rear vertical stock member further comprises a butt plate and a recoil pad joined together.

* * * * *